US010561926B2

(12) United States Patent
Flannery

(10) Patent No.: US 10,561,926 B2
(45) Date of Patent: Feb. 18, 2020

(54) STEP-IN SNOWBOARD BINDING

(71) Applicant: Paul Flannery, Cremorene (AU)

(72) Inventor: Paul Flannery, Cremorene (AU)

( * ) Notice: Subject to any disclaimer, the term of this patent is extended or adjusted under 35 U.S.C. 154(b) by 0 days.

(21) Appl. No.: 16/353,917

(22) Filed: Mar. 14, 2019

(65) Prior Publication Data

US 2019/0290995 A1 Sep. 26, 2019

(30) Foreign Application Priority Data

Mar. 21, 2018 (AU) ..... 2018900923

(51) Int. Cl.
*A63C 10/04* (2012.01)
*A63C 10/10* (2012.01)
*A63C 10/18* (2012.01)

(52) U.S. Cl.
CPC ..... *A63C 10/106* (2013.01); *A63C 10/04* (2013.01); *A63C 10/18* (2013.01); *A63C 2203/54* (2013.01)

(58) Field of Classification Search
CPC ..... A63C 10/106; A63C 10/04; A63C 10/18; A63C 10/02; A63C 10/10
USPC ..... 280/613
See application file for complete search history.

(56) References Cited

U.S. PATENT DOCUMENTS 5,997,027 A 12/1999 Jungkind
6,007,077 A 12/1999 Moe
6,116,634 A 9/2000 Mometti
6,955,362 B2 * 10/2005 Bazzi ..... A63C 10/04 280/14.22
7,207,592 B2 * 4/2007 Pascal ..... A63C 10/04 280/14.24
2004/0262887 A1 12/2004 Bazzi
2007/0182130 A1 * 8/2007 Laser ..... A63C 10/04 280/619
2016/0082343 A1 * 3/2016 Hughes ..... A63C 10/04 280/618
2016/0175689 A1 6/2016 Chen et al.

FOREIGN PATENT DOCUMENTS

WO 2008094974 A1 8/2008

OTHER PUBLICATIONS

International-type search report dated Feb. 18, 2019 from Australian provisional application No. 2018900923.

* cited by examiner

*Primary Examiner* — John D Walters
(74) *Attorney, Agent, or Firm* — Innovation Capital Law Group, LLP; Vic Lin

(57) ABSTRACT

There is provided herein and improved step in binding having a body and a footplate pivotally coupled therein at the front. A levered high back exposes load arms which are interfaced to the pivotable footplate by way of linkages. When the footplate is depressed, the linkages transition horizontally, thereby increasing rearward force and therefore leverage on the backplate, until substantially horizontally engaged. At this orientation, the linkages experiences little or no vertical vector component thereby preventing inadvertent unbinding.

20 Claims, 15 Drawing Sheets

STEP-IN SNOWBOARD BINDING

FIELD OF THE INVENTION

This invention relates generally to snowboard bindings. More particularly, this invention relates to an improved step-in snowboard binding. It should be appreciated that whereas the embodiments herein have been described with reference to utilisation for snowboards, the binding may be applicable for other types of binding arrangements, including for snow skis, water skis, wakeboards and the like.

BACKGROUND OF THE INVENTION

Snowboard bindings are employed to secure boots to a board. Conventional snowboard bindings comprise a body transitioning rearwardly to a high back which presses against the heel of the boot. The boot is secured within the body utilising a rearward ankle strap and a forward toe strap. The straps typically comprise ratchet adjustment mechanisms to adjust the length and tension thereof.

Given that strap adjustment is inconvenient, various attempts have been made at step-in snowboard bindings including WO2008094974A1 (Laser) which discloses a step-in snowboard binding comprising a body and a footplate and high back pivotally attached thereto. A linkage connects the footplate and the high back such that the pressing the footplate pulls the high back upright via linkage.

U.S. Pat. No. 9,545,560 B2 (Chen) similarly discloses a step-in snowboard binding comprising a footplate and a high back pivotally coupled to a binding body. According to the arrangement of Chen, the footplate similarly pulls the high back upright but the footplate interfaces slidably within an elongate channel of the high back, as opposed to via a linkage as disclosed by Laser.

The present invention seeks to provide an improved step-in binding, which will overcome or substantially ameliorate at least some of the deficiencies of the prior art, or to at least provide an alternative.

It is to be understood that, if any prior art information is referred to herein, such reference does not constitute an admission that the information forms part of the common general knowledge in the art, in Australia or any other country.

SUMMARY OF THE DISCLOSURE

There is provided herein and improved step-in binding configurable between opened and closed configurations. The binding comprises a body and a footplate pivotally coupled to the body at a front pivot point. In the open configuration, the footplate is raised at a rear edge thereof.

The binding further comprises a lever coupled to the body at rear laterally adjacent fulcrum points, thereby defining a rear high back supporting arm and forward load arms.

The binding further comprises a pair of linkages each connecting a respective load arm to a rear of the footplate at a rear and forward pivot points respectively.

Stepping on the footplate applies force to the respective load arms via the linkages.

The lever, linkages and footplate are configured such that, in the open configuration, the forward pivot point is above the rearward pivot point.

As such, when initially depressing the footplate, a force vector is applied to the forward load arms which predominantly comprises a vertical vector component. However, as the footplate falls to the closed configuration, the horizontal/rearward force vector component of the force vector increases while the vertical vector component decreases.

As such, at the point of closure, maximum rearward force is applied to the forward lever arms such that maximum forward force is applied to the high back when most required.

Furthermore, in the closed configuration, the forward pivot point may be substantially at or beneath the level of the rearward pivot point. As such, any forward force applied to the linkages via the high back in use comprises little or no upward vertical vector component thereby preventing the linkage from inadvertently disconnecting in use.

As compared to the prior art arrangements of Laser and Chen, the configurations of Laser and Chen do not pull the high back closed with sufficient force right at the point of closure, potentially resulting in loose bindings or requiring application of extraordinary force to the footplate.

Conversely, the present arrangement applies the maximum horizontal force vector to the high back at the point of closure when most required for a snug and tight binding.

Furthermore, the highback and footplate of the Laser and Chen arrangement apply vertical force to the front pivot arms of the highback which could open suddenly were the securement latch to disconnect or break.

Conversely, the present mechanism is failsafe in that no vertical component is applied to the forward pivot point of the linkage when force is applied to the high back, thereby preventing or reducing the likelihood of inadvertent popping open of the bindings whilst riding.

In a preferred embodiment, the forward pivot point may be additionally retained utilising a latch mechanism. Specifically, the forward pivot point of each linkage may comprise an inner cylinder which pushes past an upper ramped surface of a catch of the latch mechanism, deflecting the latch mechanism out of the way. The latch mechanism may be biased closed such that once the cylindrical portion passes the catch, the catch falls back into place, thereby retaining the inner cylindrical portions thereunderneath. Disconnection of the binding may comprise lifting a handle of the latch mechanism to release the catches.

In a preferred embodiment, the binding comprises an ankle strap which is connected between the lateral risers of the footplate.

As such, when transitioning to the closed configuration, not only does the high back pivot upwardly into place, so too does the ankle strap transitions downwardly, thereby entrapping the boot simultaneously at the heel and the ankle.

Other aspects of the invention are also disclosed.

BRIEF DESCRIPTION OF THE DRAWINGS

Notwithstanding any other forms which may fall within the scope of the present invention, preferred embodiments of the disclosure will now be described, by way of example only, with reference to the accompanying drawings in which.

DESCRIPTION OF EMBODIMENTS

Figure 1:
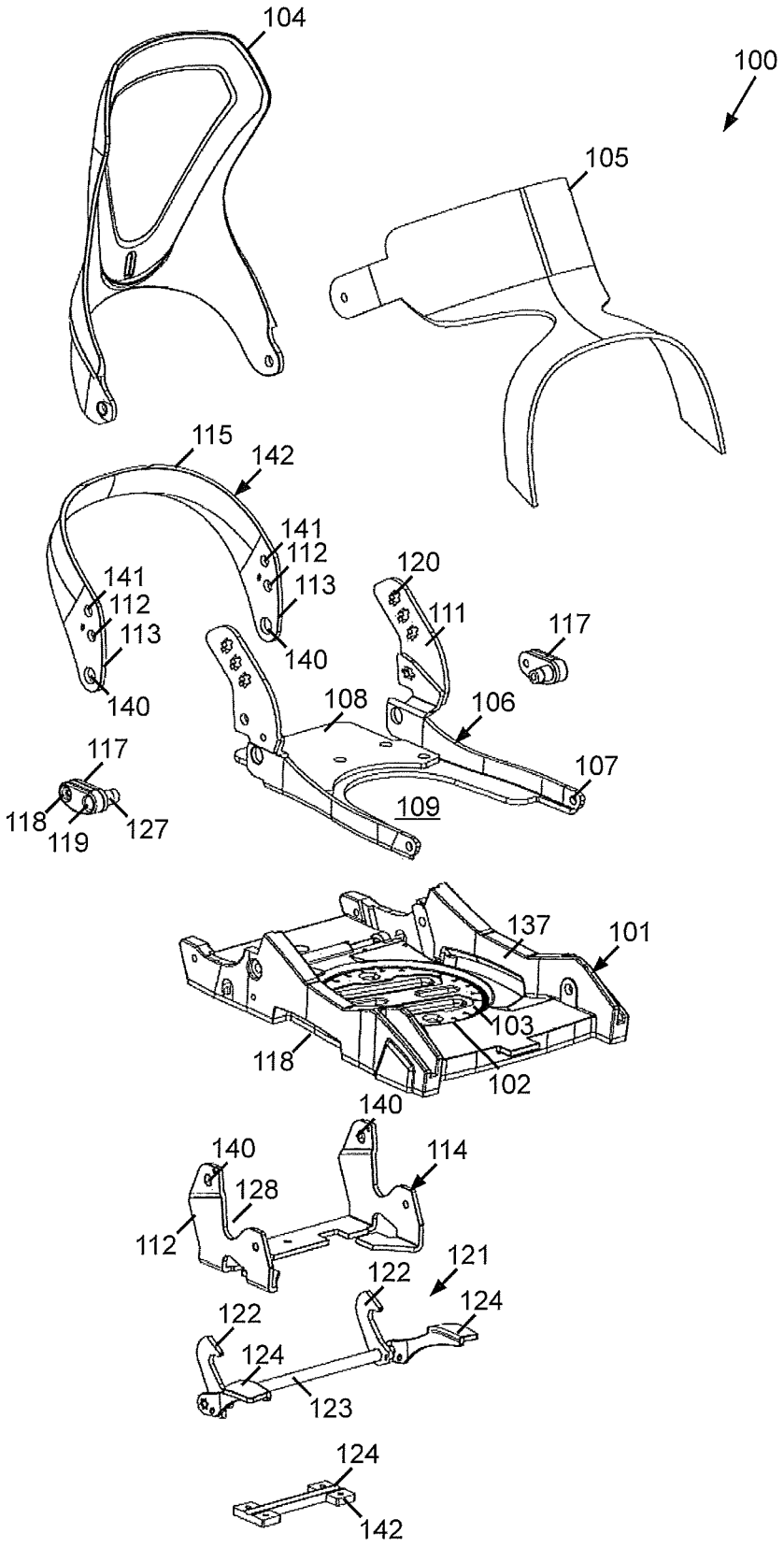
FIG. 1 shows an exploded representation of an improved step-in snowboard binding 100.

FIG. 1 shows an exploded representation of an improved step-in snowboard binding 100.

The binding 100 comprises a body 101 defining a planar undersurface for affixation to a snowboard. The body 101 comprises an annulus 102 for the rotatably offset receipt of a fixation plate 103 therein. The fixation plate 103 may be screwed to a snowboard.

The binding 100 comprises a high back 104 and ankle/toe straps 105 which may be of conventional arrangement.

The binding 100 further comprises a footplate 106 which is pivotally coupled to the body 101 at forward pivot points 107. The footplate 106 comprises a rear stomp plate 108 and a forward recess 109 such that the footplate 106 predominantly applies pressure to the heel of the boot in the manner described herein.

In embodiments, the footplate 106 may be overlaid with a rubberised footbed covering, such as one manufactured from Ethylene-vinyl acetate.

The binding 100 further comprises a lever 142 which pivots about fulcrum points 140, thereby defining a rearward high back supporting arm 115 and forward load arms 113.

The high back 114 may be pivotally coupled to the high back supporting arm 115 at pivot points 141. An angle adjustment mechanism (not shown), such as comprising a ratchet mechanism or the like, may adjust the angle of the high back 104 with respect to the high back supporting arm 115 to adjust the pressure applied by the high back 104.

The fulcrum points 140 may be supported by base support 114 affixed to the body 101. The base support 114 may comprise lateral support risers 112 leading to the respective fulcrum points 140.

The footplate 106 is coupled to the load arms 113 via linkages 117 at respective rear and forward pivot points 118, 119.

The footplate 106 may further comprise lateral footplate risers 111 which may have a plurality of fixation points 120 for the connection of the ankle strap 105 thereto at various offsets.

The binding 100 may further comprise a latch mechanism 121 for locking the binding 100 closed. The latch mechanism 121 may comprise a pair of catches 122 that pivot about transverse rod 123 that rotates within a channel 124 of a seat 142. The catches 122 may catch inner cylindrical sections 127 of the linkages 117 in the closed configuration. The catches 122 may be biased forwardly under spring loading and the latch mechanism 121 may comprise handles 124 which, when lifted, move the catches 122 rearwardly to release the cylindrical sections 127 to unbind the bindings.

Figure 2:
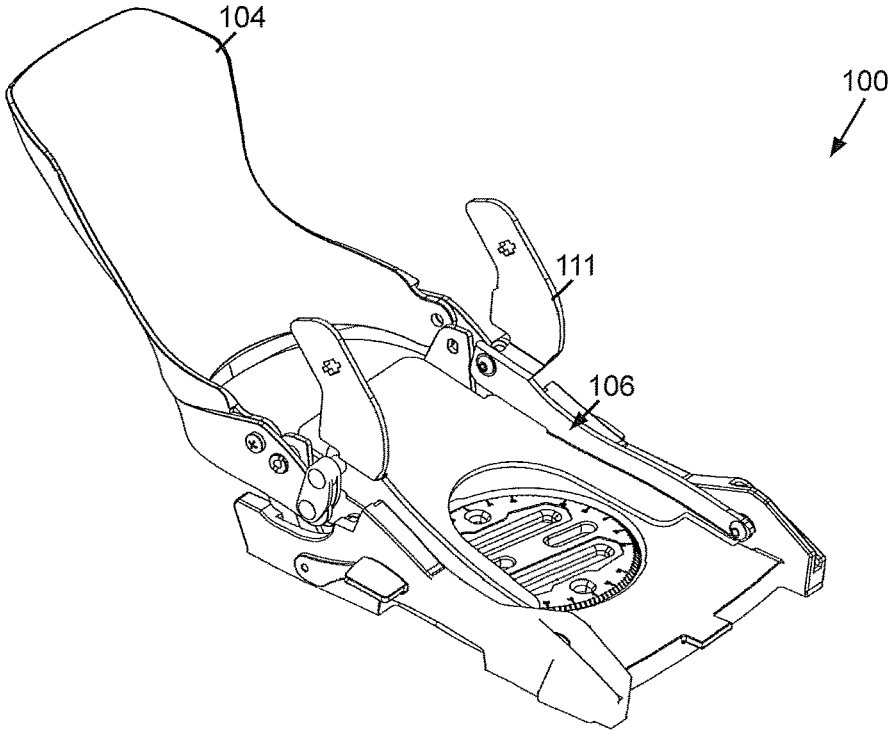
FIG. 2 shows an exploded representation of an improved step in snowboard binding in accordance with a preferred embodiment.
Figure 3:
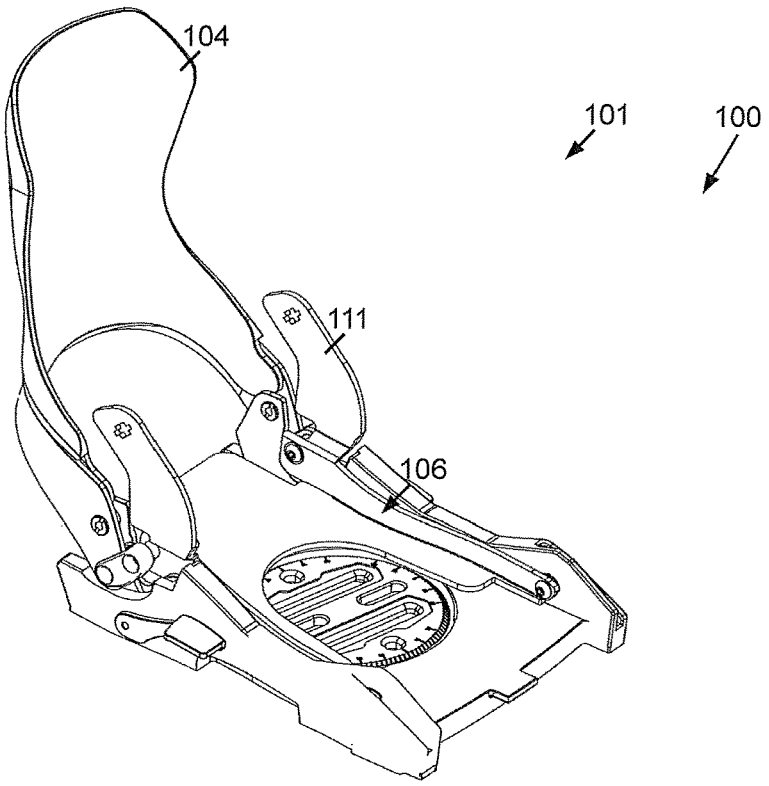
FIGS. 3-4 show top perspective views as the binding transitions from open to closed configurations.
Figure 5:
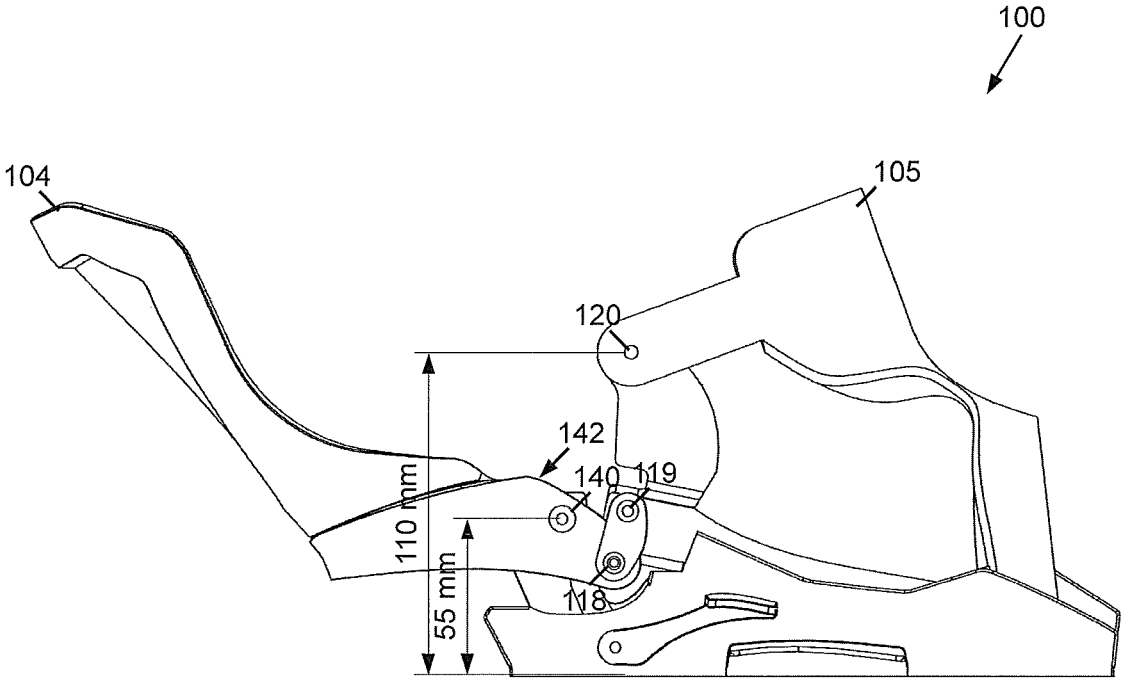
FIGS. 5-8 show right side elevation views as the binding transitions from open to closed configurations.
Figure 9:
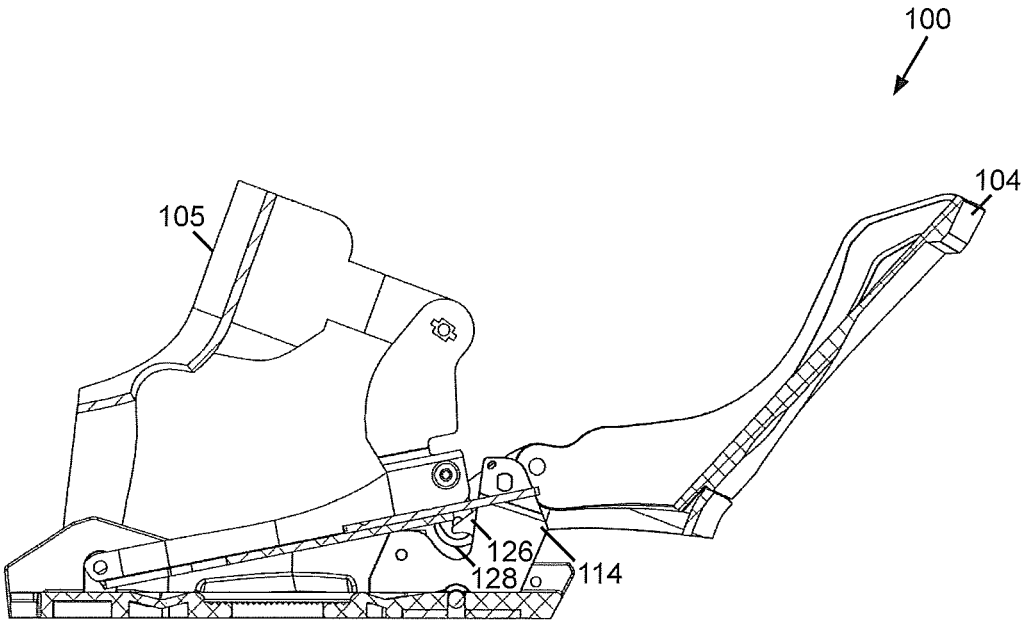
FIGS. 9-11 show left side cross-sectional elevation views as the binding transitions from opened to closed configurations.

FIGS. 2, 5 and 9 show respective top perspective, right side elevation and left side cross-sectional elevation views of the binding 100 in the open configuration. As can be seen from FIG. 5, in the open configuration, the lever 142 is pivoted rearwardly around the fulcrum point 140 such that the high back 104 lies back. Furthermore, the rear of the footplate 106 is raised such that the ankle straps 105 are similarly raised via the footplate risers 111. As such, in the open configuration, a boot may be inserted freely into the opening between the high back 104 and the ankle strap 105.

FIGS. 3, 6, 7 and 10 show the binding 100 transitioning to the closed configuration. Specifically, and with reference to FIGS. 6 and 7, once having inserted the boot, pressure is applied to the stomp plate 108 of the footplate 106. As can be seen from FIG. 5, in the open configuration, the forward pivot point 119 is above the rearward pivot point 118, such that downward force applied to the footplate 106 applies predominantly downward force on the forward load arms 113.

Figure 6:
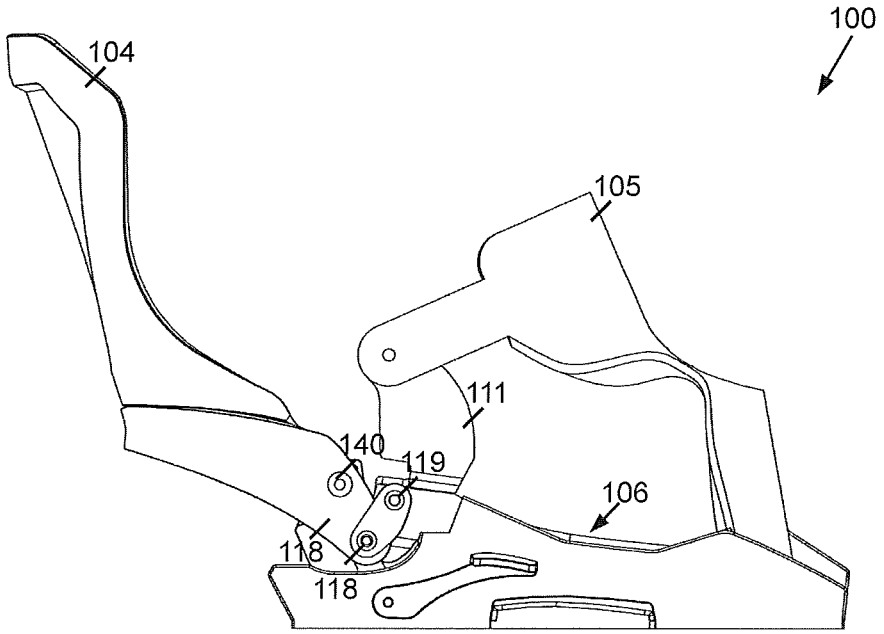
Figure 7:
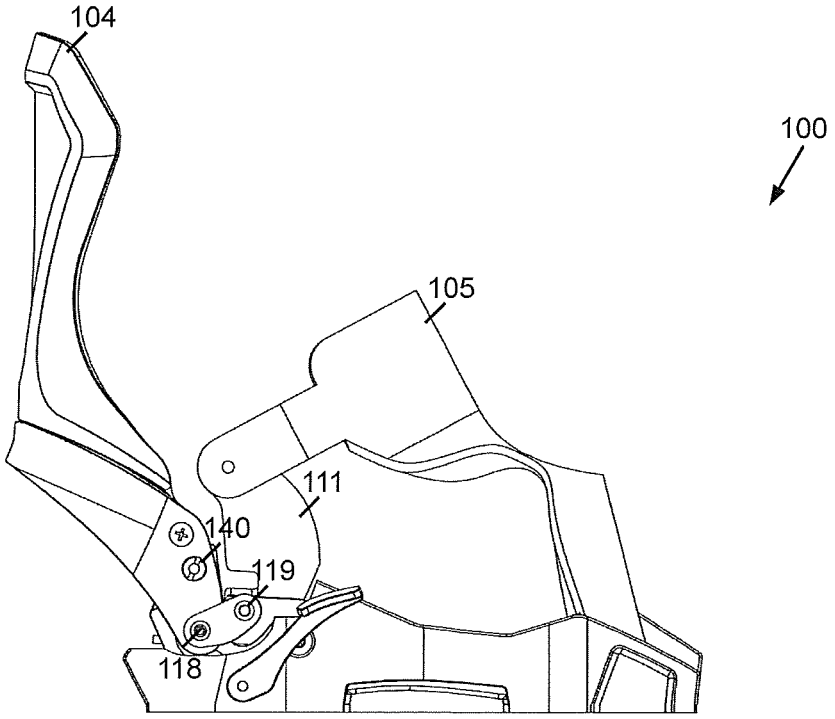

However, as is apparent from the transition illustrated in FIGS. 6 and 7, as the footplate 106 falls, the linkage 117 transitions more horizontally such that the elevation of the forward pivot point 119 tends towards that of the rearward pivot point 118. As such, towards the point of closure, the linkage 117 applies increasing rearward force to the forward load arms 113 that the forward force of the high back 104 is maximised at the point of closure.

Figure 4:
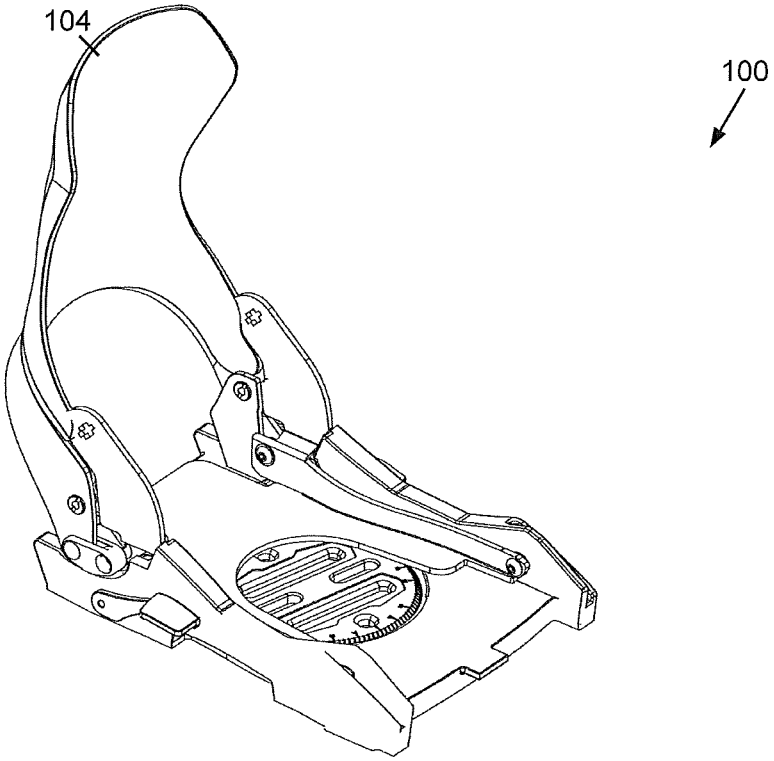
Figure 8:
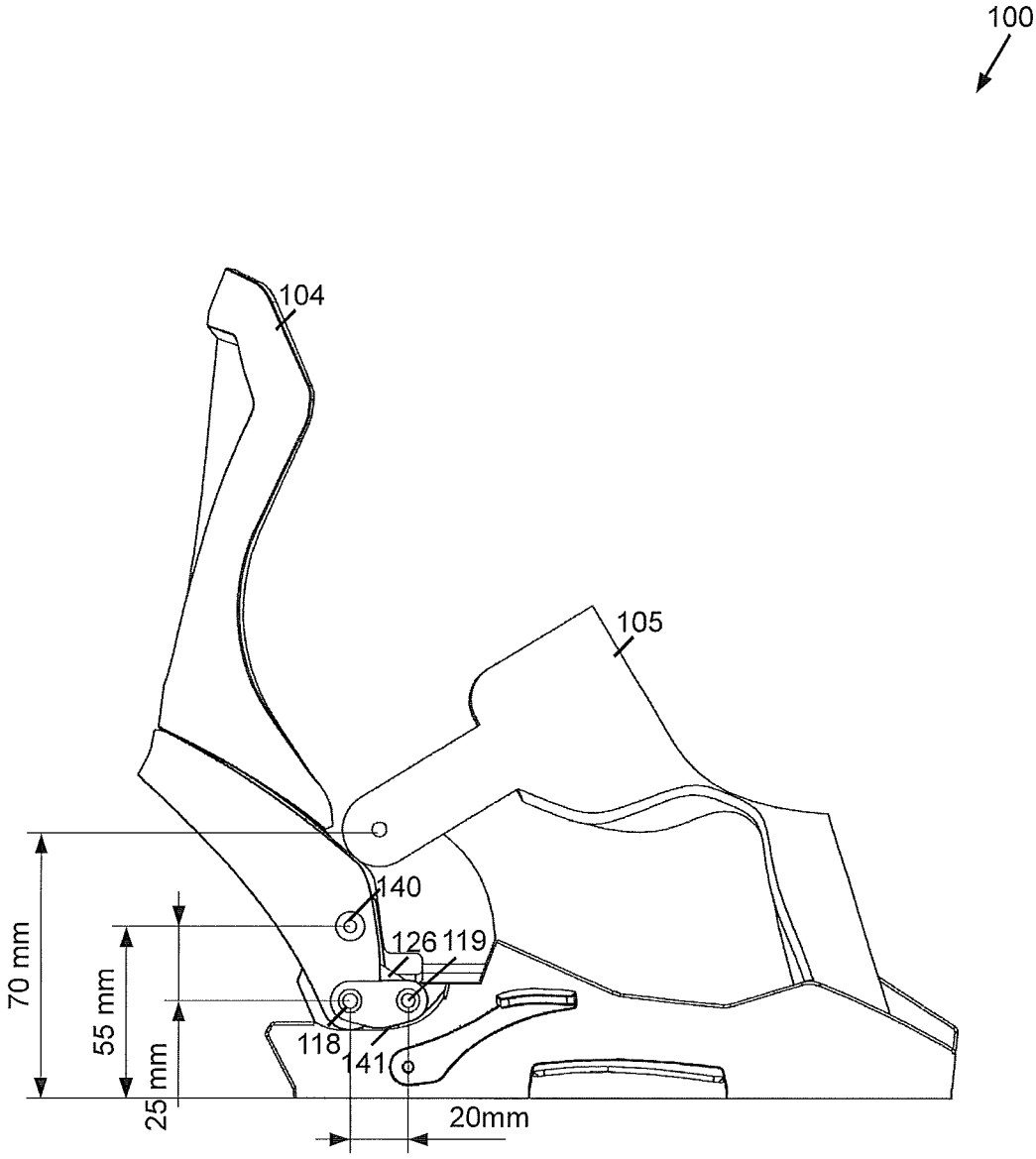
Figure 12:
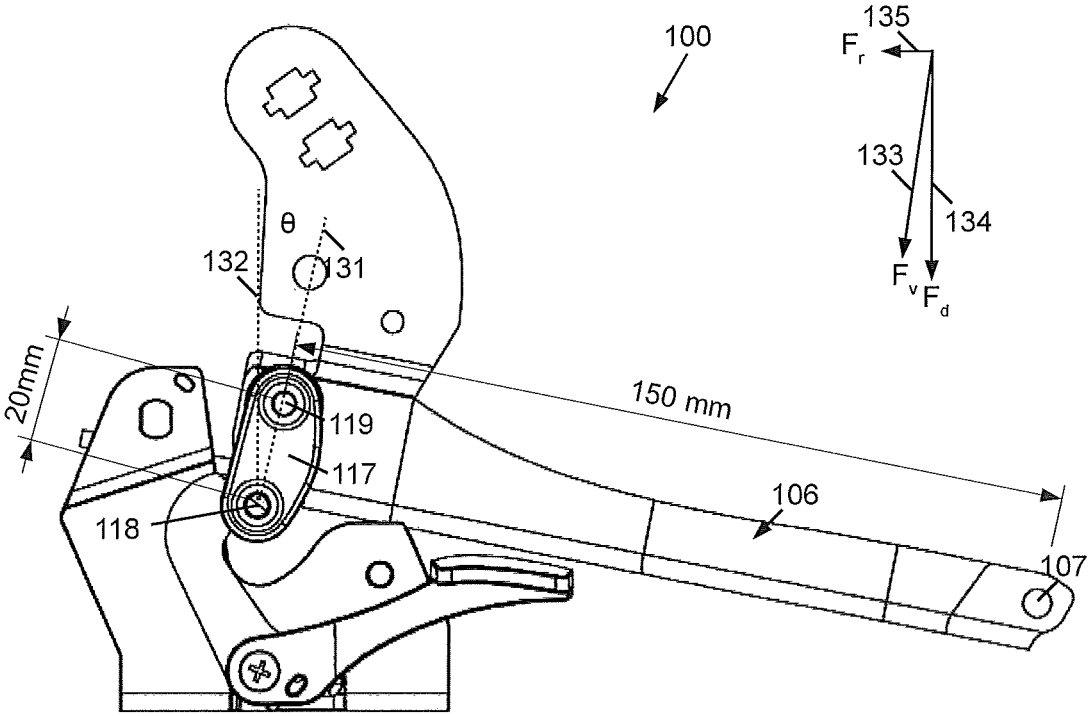
FIGS. 12-15 show side elevation views illustrating the operation of the linkages between the footplate and the high back lever in further detail.

Specifically, FIGS. 4, 8 and 12 show the binding 100 in the closed configuration. As can be appreciated from FIG. 8, the high back 104 has transitioned forward and the ankle strap 105 is lowered, thereby closing against the boot.

Furthermore, the linkage 117 may be substantially horizontal such that the forward pivot point 119 is substantially at the same level or lower than the rearward pivot point 118 which induces little or no vertical force component on the forward pivot point 118, thereby preventing disconnection when force is applied to the high back 104.

Furthermore, the rearward pivot point 118 may be substantially underneath the fulcrum point 140.

As can be further appreciated from FIG. 8, the linkage 117 may space the rearward and forward pivot points 118, 119 by approximately 20 mm. In the closed configuration, the rearward pivot point 118 may lie approximately 25 mm beneath the fulcrum point 140 in a substantially right angled configuration.

FIG. 8 further illustrates the catches 126 having transitioned forward so as to catch the cylindrical portions 127 of the linkages 117, thereby preventing the forward pivot point 119 from rising until such time that the handle 125 is pulled to release the catches 126.

FIG. 9 illustrates the base support 114 comprising a seat 128 and the catch 126 jutting in above the seat 128. The upper edge of the catch 126 may be slanted such that the cylindrical portion 127 of the linkage 127 pushes the catch 127 rearwardly so as to fall into the seat 128. Once in the recess 128, the catch 122 moves forwardly such that the catch 126 again juts into the recess 128 above the cylindrical portion 127, thereby entrapping the cylindrical portion 127 therein.

Figure 10:
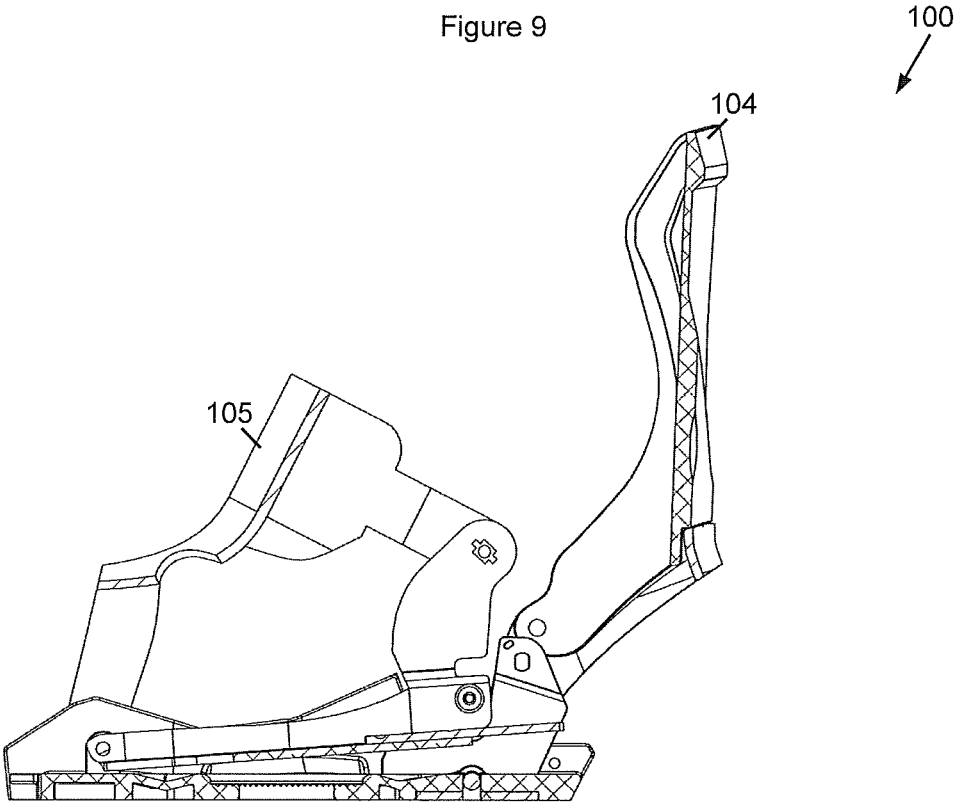
Figure 11:
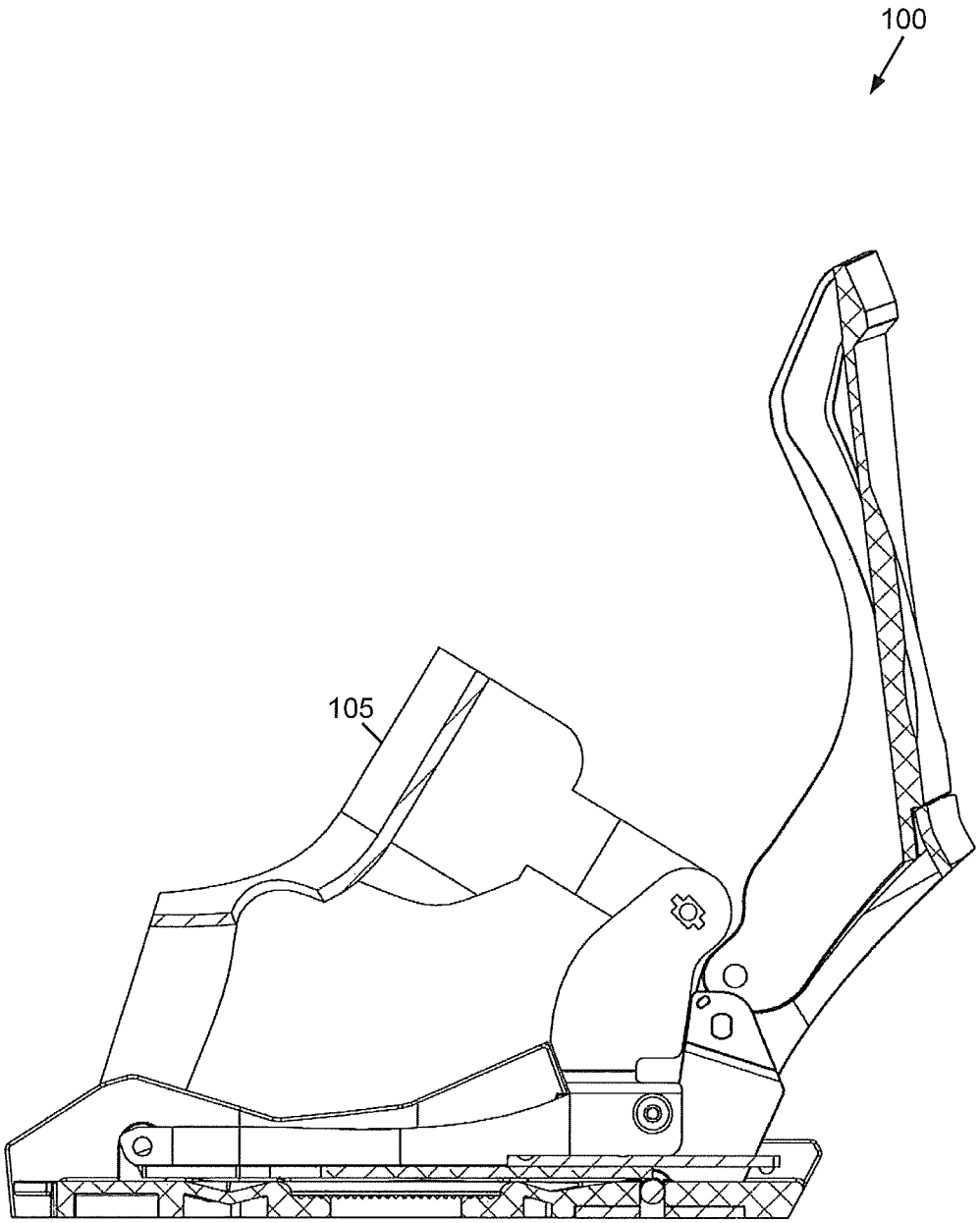

FIGS. 9-11 further illustrate the planar undersurface of the footplate 106 which lies substantially flush against the upper surface of the base 101 in the closed configuration as is substantially shown in FIG. 11 and the forward footplate pivot point 107 which may locate substantially at the connection point of the toe strap 105. These figures further illustrate the body 101 comprising side ports for the release of any snow entrapped under the footplate 106 therefrom.

In the embodiment shown in FIGS. 5 and 8, the fulcrum point 140 may be approximately 55 millimetres above the undersurface of the body 101. Furthermore, in the open configuration as is substantially illustrated in FIG. 5, the fixation point 120 of the ankle strap 105 may be approximately 110 millimetres above the undersurface of the body 101 whereas in the closed configuration shown in FIG. 8, the fixation point 120 may have fallen to 70 millimetres from the undersurface of the body 101.

Figure 13:
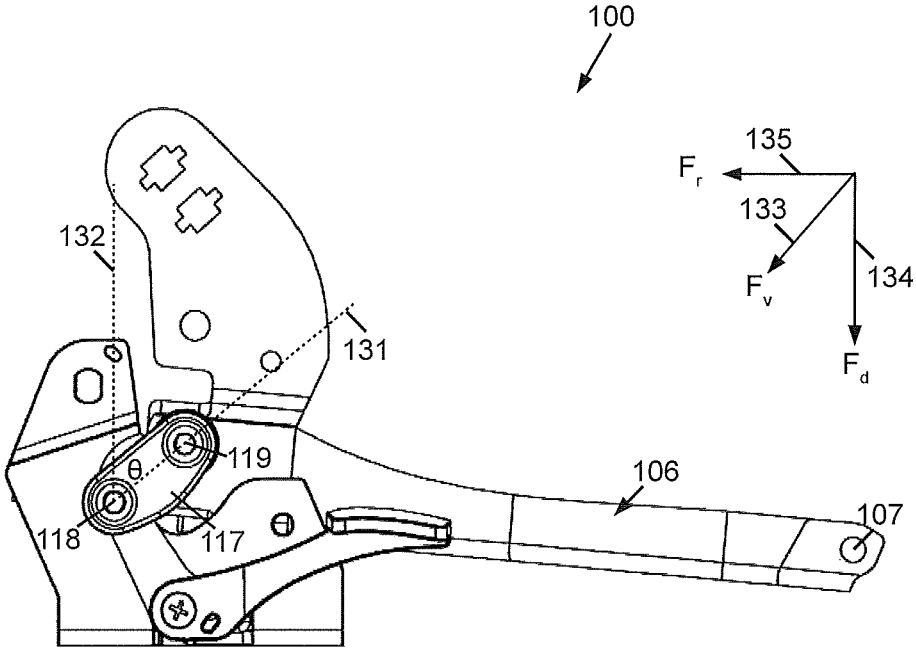
Figure 14:
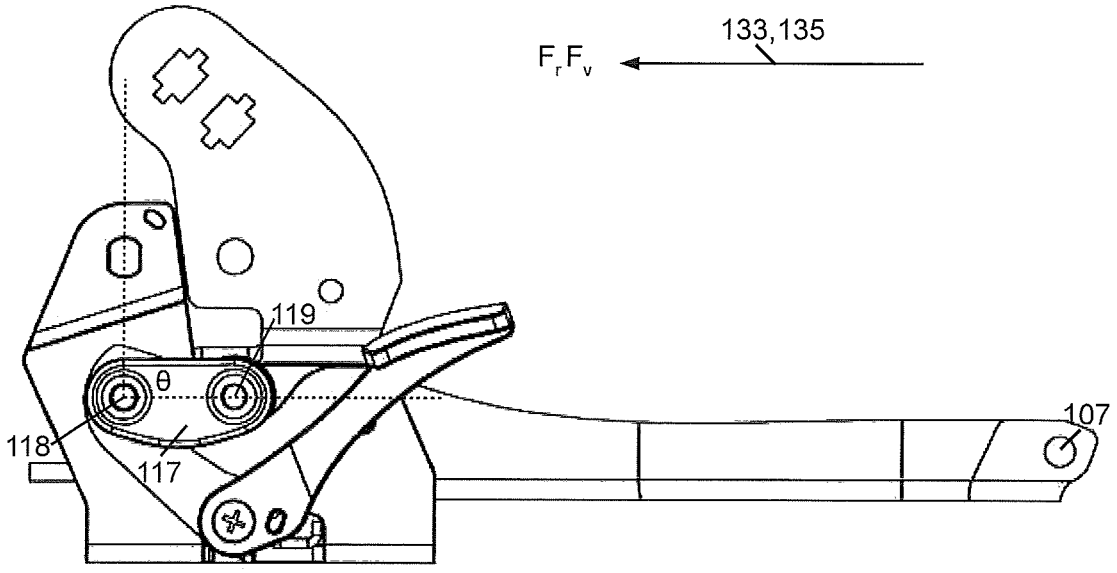
Figure 15:
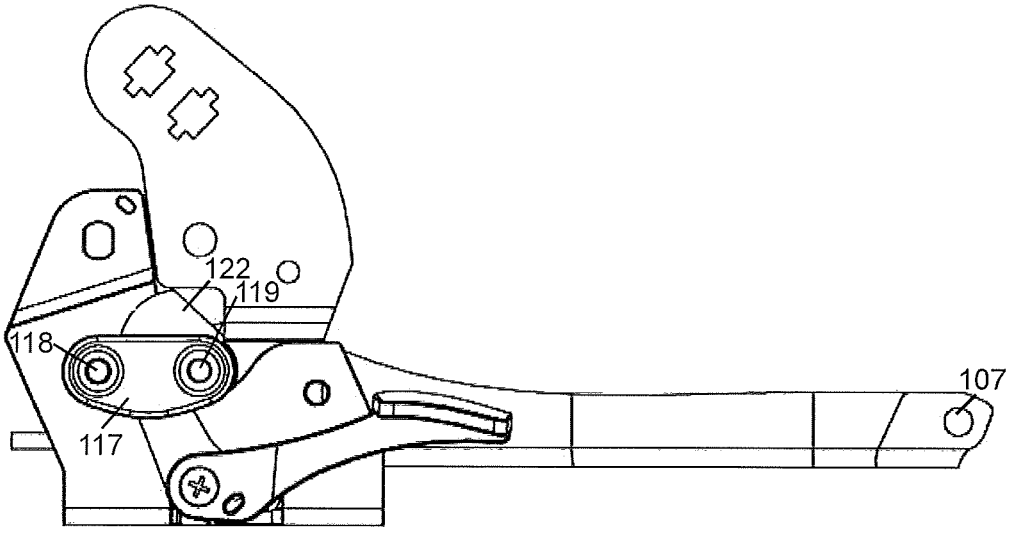
Figure 16:
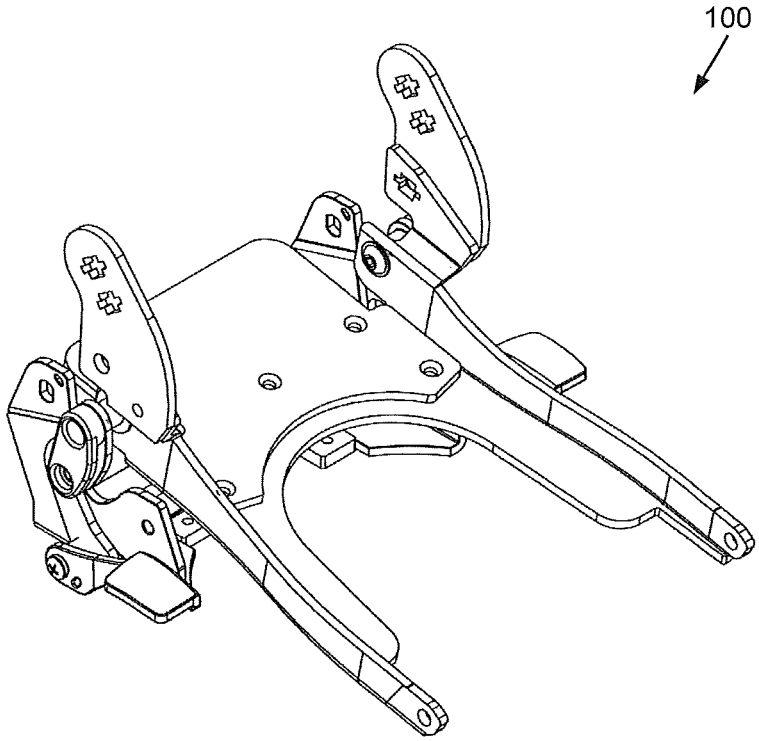
FIGS. 16-19 show top perspective views illustrating the operation of the linkages between the footplate and the high back lever in further detail.
Figure 17:
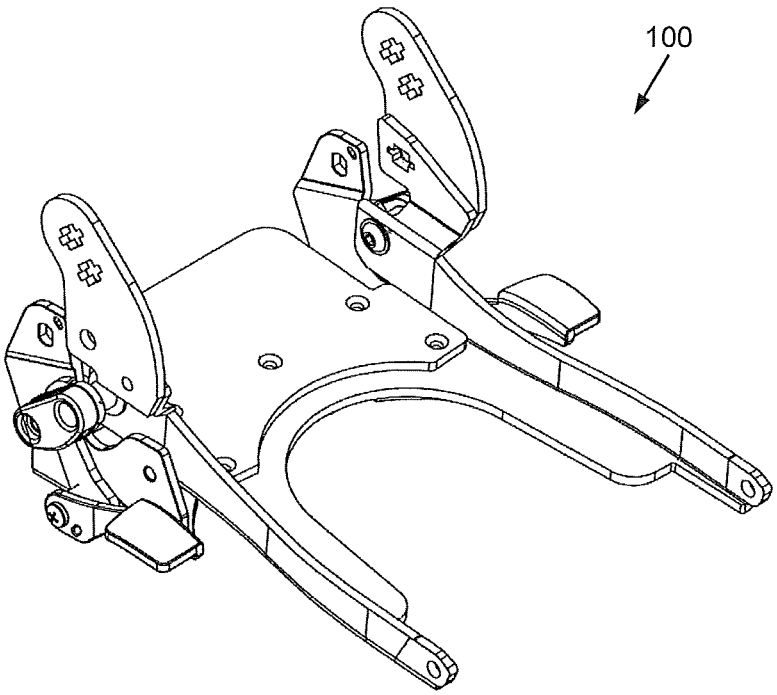
Figure 18:
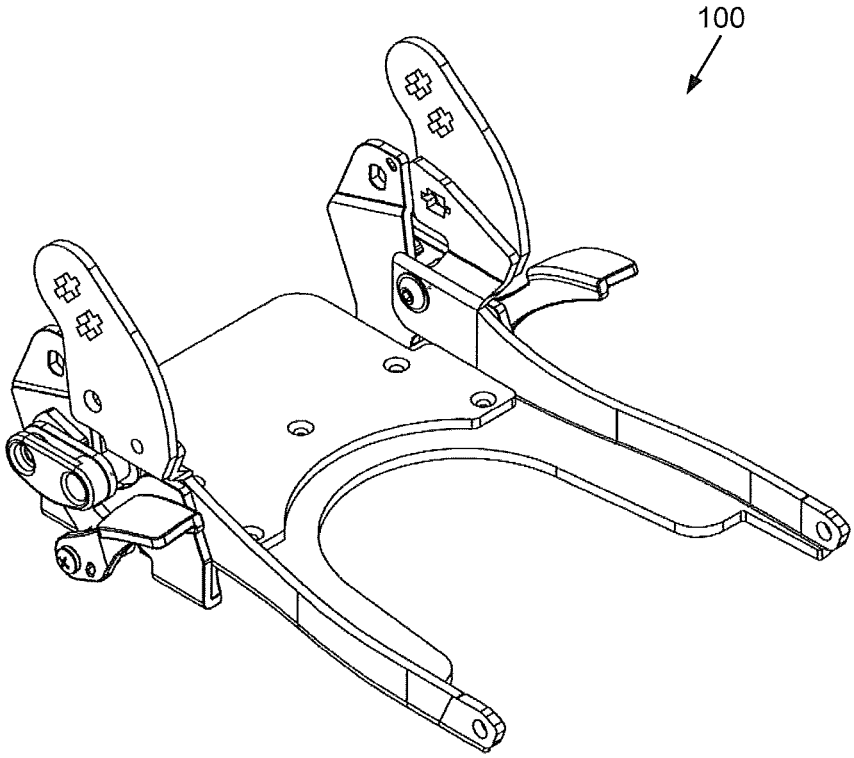
Figure 19:
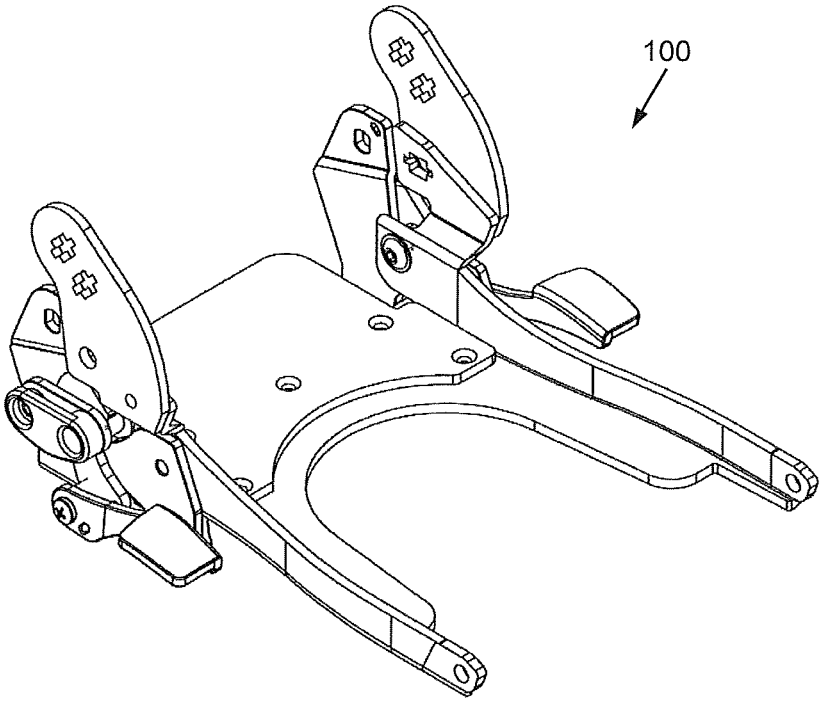
Figure 20:
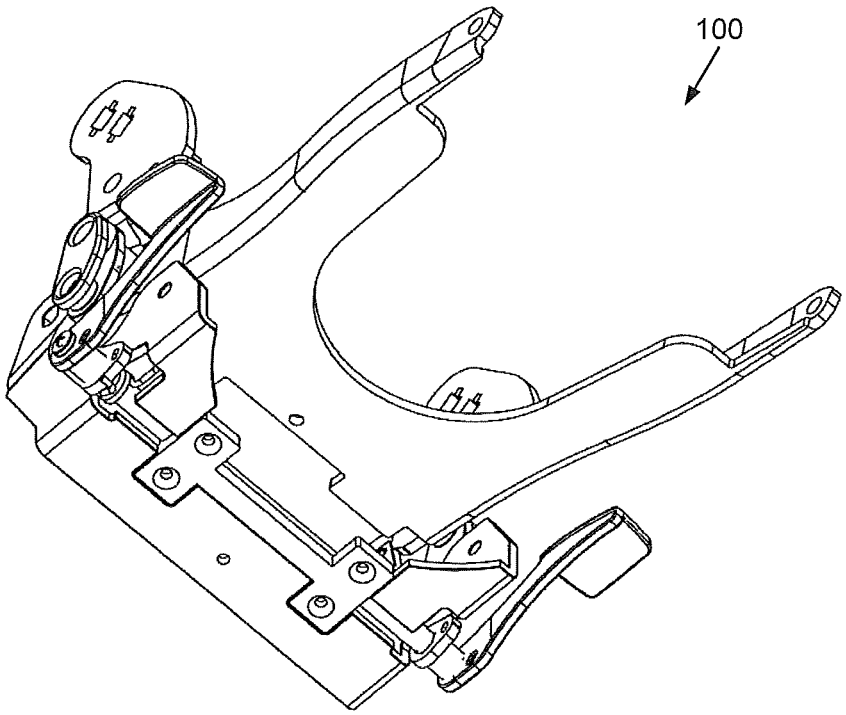
FIGS. 20-23 show bottom perspective views illustrating the operation of the linkages between the footplate and the high back lever in further detail.
Figure 21:
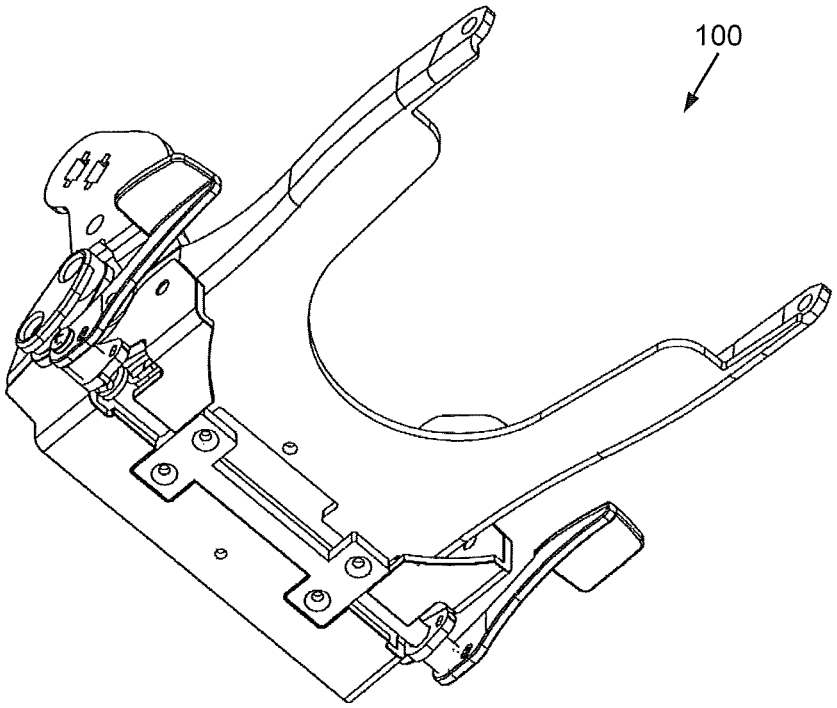
Figure 22:
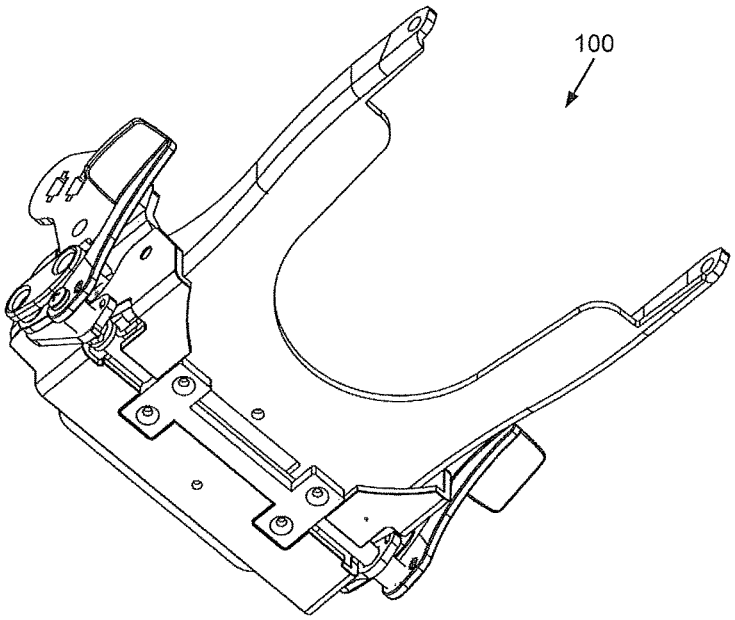
Figure 23:
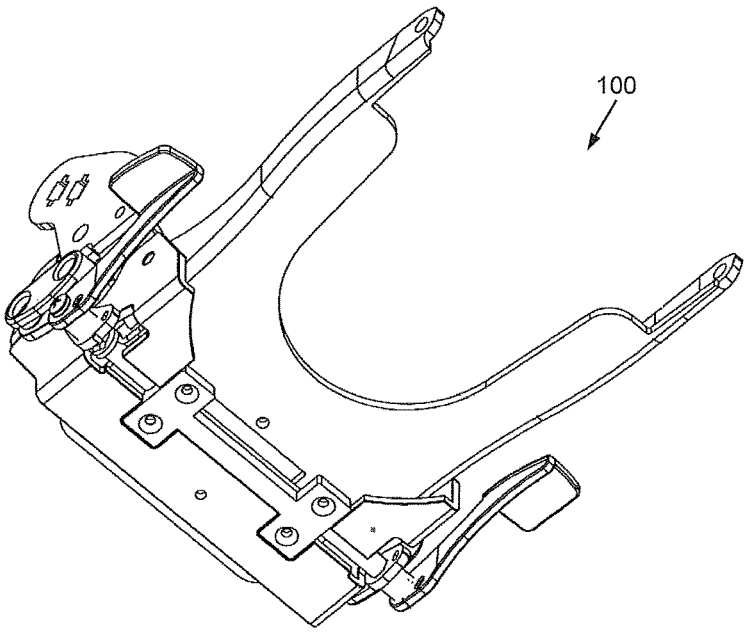

FIGS. 12-15 illustrate the force vector components acting on the high back 104 and ankle straps 105 as the binding 100 transitions from the open configuration shown in FIG. 12 to the closed configuration illustrated in FIG. 15. FIGS. 16-19 show corresponding respective top perspective views and FIGS. 20-23 show a corresponding respective bottom perspective views of the binding 100.

As can be seen from FIG. 12, in the open configuration, the footplate 106 is raised such that the forward pivot point 119 is above the rearward pivot point 118 such that the angle θ between the elongate axis 131 of the linkage 117 and the vertical 132 is acute, such as approximately 0°-10°.

As such, downward pressure on the footplate 106 generates a resultant force vector 133 having a predominantly vertical component as opposed to a horizontal component 135.

However, as is shown in FIG. 13, as the footplate 106 falls, the angle θ between the elongate axis 131 and the vertical 132 increases such that the horizontal component 135 of the resultant force vector 133 increases whilst the vertical force vector component 134 decreases.

FIG. 14 illustrates the closed configuration wherein, as can be seen, the forward pivot 119 is at or below the rearward pivot point 118. As can be seen, at the point of closure, the resultant force vector 133 comprises mostly or entirely a horizontal force vector component 135 thereby advantageously applying maximum horizontal force on the high back 100 for at the point of closure.

Furthermore, with the forward pivot point 119 being located at a beneath the rearward pivot point 118, forward force applied to linkage 117 from the high back 104 applies little or no vertical vector component at the forward pivot point 119 such that the forward pivot point 119 will not tend upwardly from the seat 128 in use.

FIG. 15 illustrates the catches 122 transitioning forwardly to catch above the inner cylindrical portions 127 of the linkages 117, thereby preventing the forward pivot point 119 from rising from the seat 128.

To disconnect the binding 100, the handle 125 is raised to pivot the catches 122 backwardly to release the cylindrical portions 127. Simultaneously, the ankle straps 105 may be pulled so as to apply a vertical force component at the forward pivot point 119 to raise the forward pivot point 119 from the seat 128.

Figure 24:
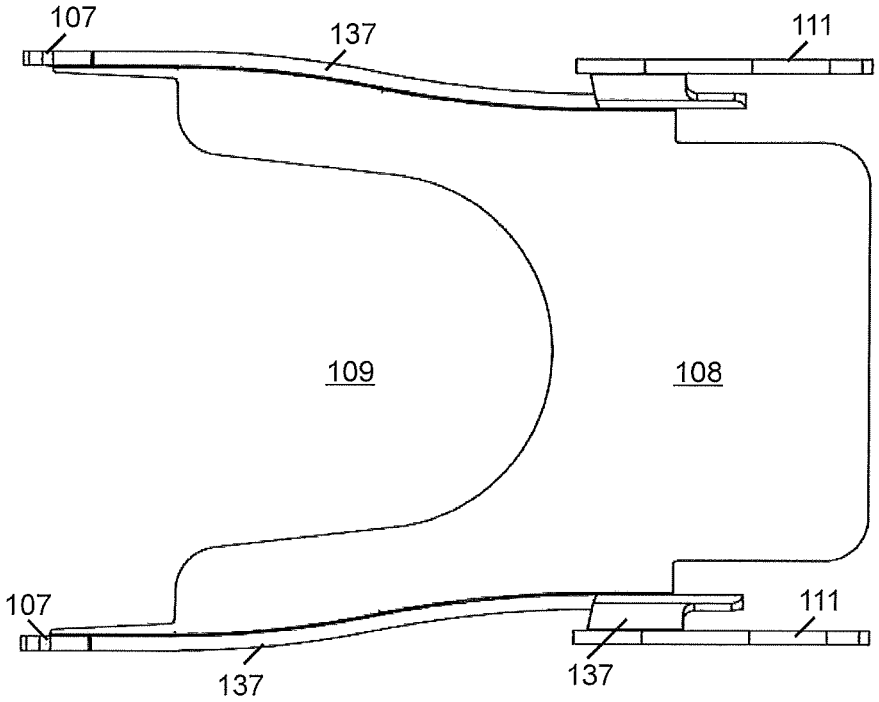
FIG. 24 shows a top plan view of the footplate.
Figure 25:
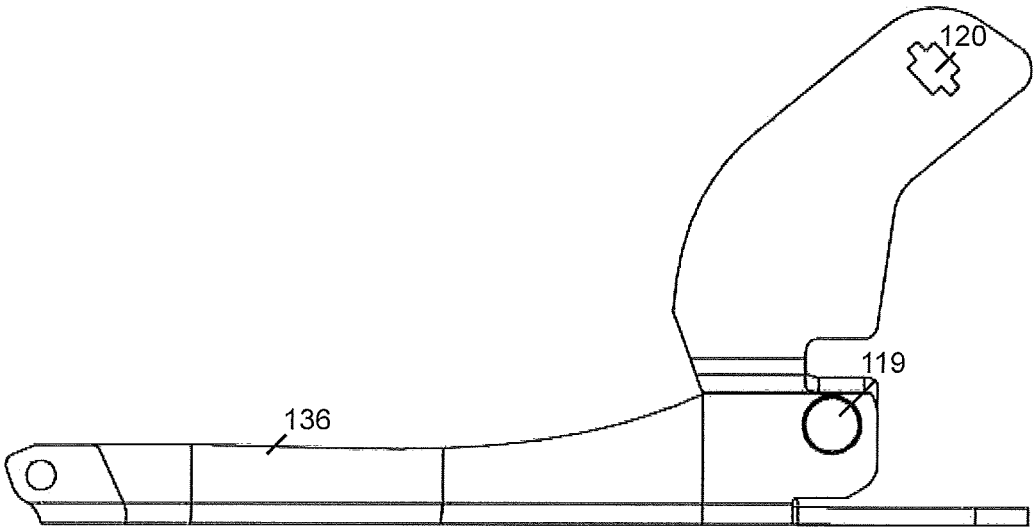
FIG. 25 shows a side elevation view of the footplate.
Figure 26:
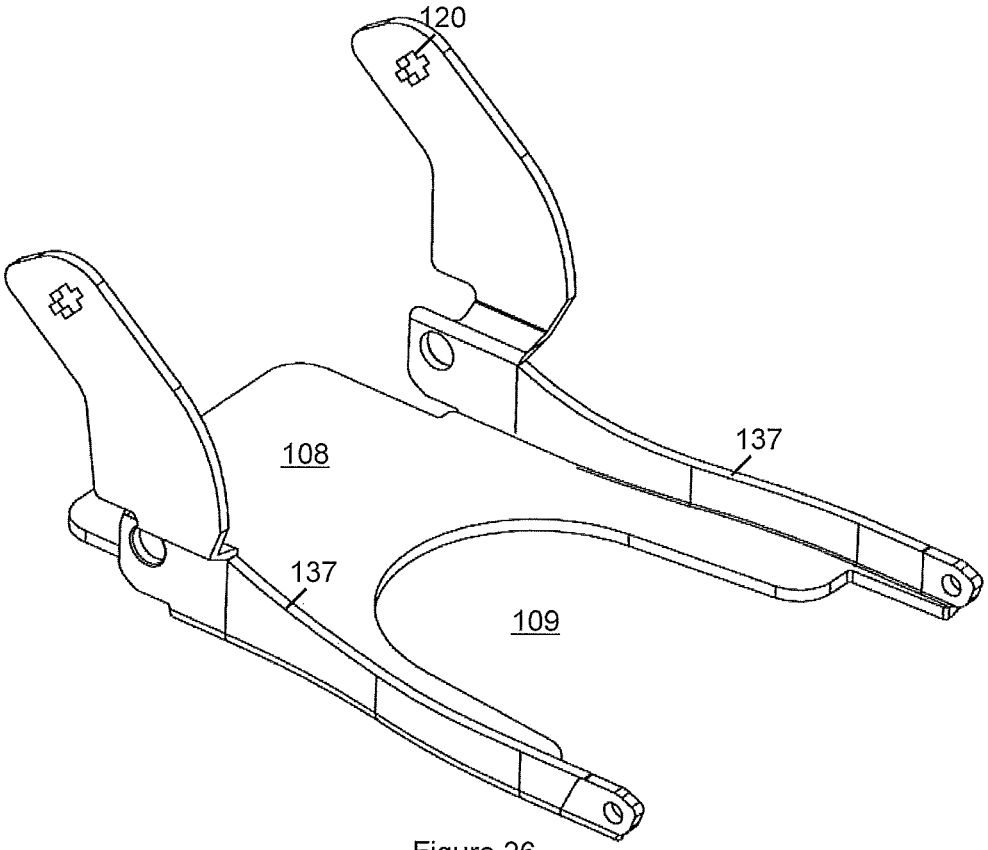
FIG. 26 shows a top perspective view of the footplate.

FIGS. 24-26 illustrate the footplate 106 in top plan, side elevation and top front perspective views respectively. As can be seen, and as alluded to above, the footplate 106 defines forward footplate pivot points 107 for pivotal connection to the body 101 at a forward region of the body 101. The footplate 106 comprises a rear stomp plate 108 and a forward recess 109 such that force is predominantly applied to the heel of the boot in use. As such, downward pressure on the stomp plate 109 pulls the footplate risers 111 downwardly and also applies force at the forward pivot points 119.

The footplate 106 may comprise side walls 136 that locate against corresponding inner side walls 137 of the body 101.

With reference to FIG. 24, the sidewalls 136 may narrow in towards the rear of the footplate 106 towards the stomp plate 108.

The risers 111 may comprise outward transitions 137 to place the risers 111 laterally from the sidewalls 136.

Figure 27:
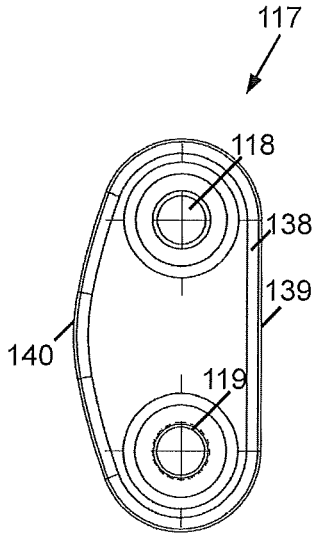
FIGS. 27-29 show the linkage in further detail in accordance with an embodiment.
Figure 28:
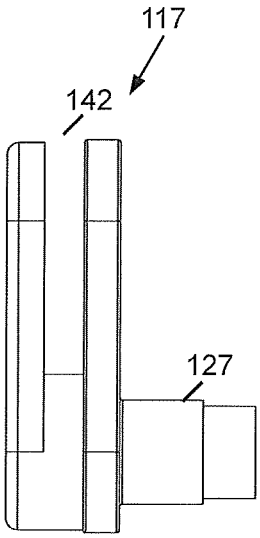
Figure 29:
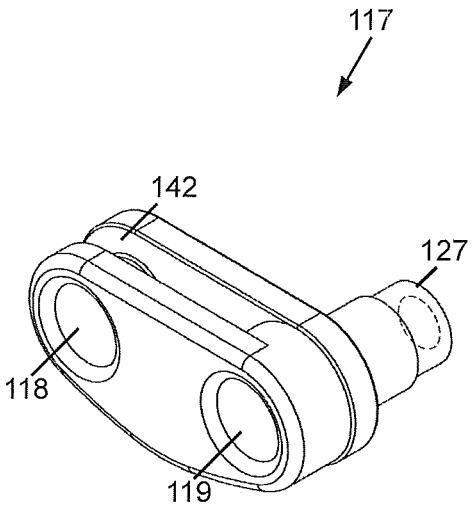

FIGS. 27-29 illustrate the linkage 117 in further detail. The linkage 117 may comprises a generally elongate body 138 comprising the forward pivot point 119 and the rearward pivot point 118 at opposite ends thereof. The elongate body 138 may comprise a straight upper edge 139 and a curved lower edge 140. The curved lower edge 140 may conform with a corresponding curvature 141 of the body 101 as is substantially illustrated in FIG. 8.

The rear of the body 139 may be bifurcated thereby defining a channel 142 therebetween for the accommodation of the planar forward load arms 113 therebetween. The front end of the linkage 127 may transition laterally to the inner cylindrical portion 127.

The foregoing description, for purposes of explanation, used specific nomenclature to provide a thorough understanding of the invention. However, it will be apparent to one skilled in the art that specific details are not required in order to practice the invention. Thus, the foregoing descriptions of specific embodiments of the invention are presented for purposes of illustration and description. They are not intended to be exhaustive or to limit the invention to the precise forms disclosed; obviously, many modifications and variations are possible in view of the above teachings. The embodiments were chosen and described in order to best explain the principles of the invention and its practical applications, they thereby enable others skilled in the art to best utilize the invention and various embodiments with various modifications as are suited to the particular use contemplated. It is intended that the following claims and their equivalents define the scope of the invention.

The invention claimed is:

1. An improved step-in binding configurable between opened and closed configurations and comprising:

a body;

a footplate pivotally coupled to the body at a front pivot point such that, in the open configuration, the footplate is raised at a rear edge thereof;

a lever coupled to the body at a rear laterally adjacent fulcrum points thereby defining a rear high back supporting arm and a forward load arms;

a pair of linkages each connecting a respective load arm to a rear of the footplate at rear and forward pivot points respectively and wherein, in the open configuration, the forward pivot point locates above the rearward pivot point.

2. An improved step-in binding as claimed in claim 1 wherein, in the closed configuration, the forward pivot point locates substantially at the same level or beneath the level of the rearward pivot point.

3. An improved step-in binding as claimed in claim 1 wherein, in the closed configuration, each rearward pivot point locates beneath a respective fulcrum point.

4. An improved step-in binding as claimed in claim 1 wherein each linkage comprises a length of approximately 20 mm between the forward and rearward pivot points.

5. An improved step-in binding as claimed in claim 1 wherein, in the open configuration, the linkages are orientated at an angle of between 0°-10° between an elongate axis of the linkages and the vertical.

6. An improved step-in binding as claimed in claim 1 wherein, in the closed configuration, the linkages are orientated at an angle of greater than 70° between the vertical and an elongate axis of the linkages.

7. An improved step-in binding as claimed in claim 1 wherein, in the closed configuration, the linkages are orientated at an angle of greater than 80° between the vertical and an elongate axis of the linkages.

8. An improved step-in binding as claimed in claim 1 wherein, in the closed configuration, the linkages are orientated at an angle of greater than 90° between the vertical and an elongate axis of the linkages.

9. An improved step-in binding as claimed in claim 1 further comprising a latch mechanism comprising at least one catch which catches one of the linkages at the forward pivot point in the closed configuration.

10. An improved step-in binding as claimed in claim 9 wherein the at least one catch is biased towards a catching position and wherein the latch mechanism further comprises a lever handle which, when raised, moves the at least one catch away from the catching position.

11. An improved step-in binding as claimed in claim 9, wherein each linkage comprises a forward in a cylindrical section.

12. An improved step-in binding as claimed in claim 1, further comprising an ankle strap and wherein the ankle strap is connected to a rear of the footplate.

13. An improved step-in binding as claimed in claim 12, wherein the footplate comprises lateral footplate risers comprising at least one ankle strap connection points.

14. An improved step-in binding as claimed in claim 1, further comprising a base support comprising lateral base support risers comprising apertures for the fulcrum points.

15. An improved step-in binding as claimed in claim 14 wherein the lateral base support risers comprise a seat for the receipt of the forward pivot point therein in the closed configuration.

16. An improved step-in binding as claimed in claim 1, wherein each linkage comprises a rearward bifurcation for rotatably engaging either side of a forward load arm.

17. An improved step-in binding as claimed in claim 1, further comprising a high back pivotally coupled to the high back supporting arm and further comprising an angle offset adjustment mechanism between the high back and the high back supporting arm.

18. A method of binding a boot, the method comprising inserting a boot between a high back and an ankle strap of a binding comprising:

a body;

a footplate pivotally coupled to the body at a front pivot point such that, in the open configuration, the footplate is raised at a rear edge thereof;

a lever coupled to the body at a rear laterally adjacent fulcrum points thereby defining a rear high back supporting arm and a forward load arms;

a pair of linkages each connecting a respective load arm to a rear of the footplate at rear and forward pivot points respectively and wherein, in the open configuration, the forward pivot point locates above the rearward pivot point, wherein the method comprises:

applying force to the footplate with the boot such that the linkages initially apply a force vector to the forward load arms comprising a predominating vertical vector component and wherein as the footplate falls, the linkages transition such that force vector transitions to comprise a predominating horizontal vector component.

19. A method as claimed in claim 18, wherein, at a point of closure, the linkages apply substantially no vertical force vector component to the forward load arms.

20. A method as claimed in claim 18, wherein the method further comprises allowing catches of a latch mechanism to catch above at least one linkage at the forward pivot point and releasing the binding by pulling a lever handle of the latch mechanism to pull the catch away from the linkage.

* * * * *